United States Patent [19]

Rath

[11] 4,179,988

[45] Dec. 25, 1979

[54] STAMPING DEVICE FOR ROTATING WORKPIECES

[76] Inventor: Jack Rath, 9823 Kincardine Ave., Los Angeles, Calif. 90034

[21] Appl. No.: 894,930

[22] Filed: Apr. 10, 1978

[51] Int. Cl.[2] ..... B41F 17/22

[52] U.S. Cl. ..... 101/7; 101/38 R

[58] Field of Search ..... 101/7, 5, 35, 38 R, 101/3

[56] References Cited

U.S. PATENT DOCUMENTS

| | | | |
|---|---|---|---|
| 1,551,376 | 8/1925 | Duchemin | 101/7 |
| 1,960,870 | 5/1934 | Engstrom | 101/7 |
| 2,417,865 | 3/1947 | Douglass | 101/7 |
| 2,923,232 | 2/1960 | Worth | 101/7 UX |
| 3,188,943 | 6/1965 | King et al. | 101/7 |
| 3,205,813 | 9/1965 | Brinkman et al. | 101/7 |

*Primary Examiner*—Clifford D. Crowder
*Attorney, Agent, or Firm*—T. L. Stam

[57] ABSTRACT

An improved device for the stamping of identification or other insignia on work pieces as part of the operations performed thereon in rotating machines such as lathes, automatic lathes, screw machines or the like. The stamping device is carried on a tool slide of the machine for movement toward and away from the work piece and includes a stamp having a flat face containing raised characters intended to be imprinted in the work piece, means to move the stamp to an extreme outer position when the slide is withdrawn from the work piece and to latch the stamp in said outer position, and means responsive to contact of the stamp assembly with the rotating work piece as the slide is moved toward the work piece to release the latch means. Spring means accelerate the stamp assembly in a direction such that the first character on the stamp engages the work piece, at which time the work piece drives the stamp past the work with stamp and work surfaces moving together to imprint the characters on the stamp into the work piece surface.

16 Claims, 8 Drawing Figures

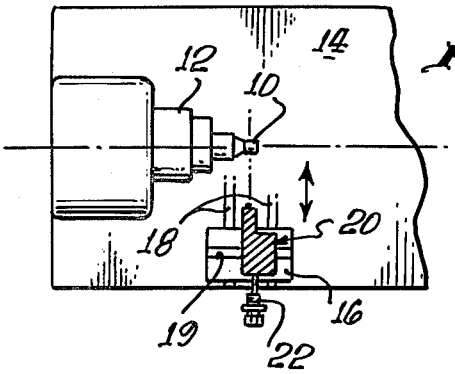
FIG. 1.
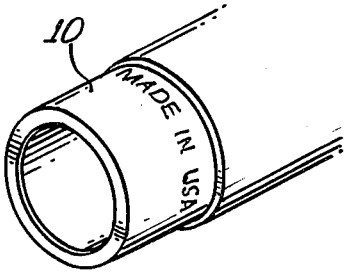
FIG. 4.
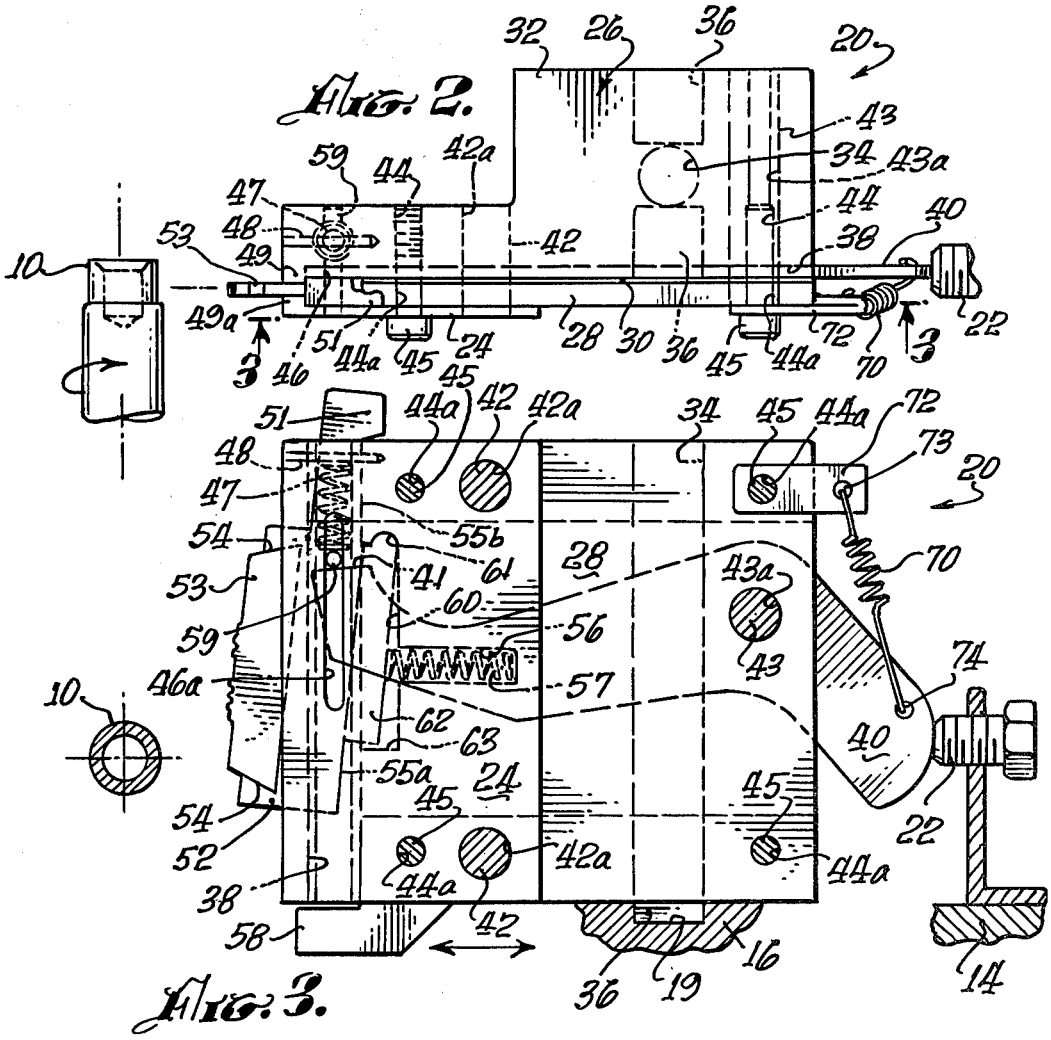
FIG. 2.
FIG. 3.

STAMPING DEVICE FOR ROTATING WORKPIECES

BACKGROUND OF THE INVENTION

1. Field of the Invention

This invention relates to stamps, and more particularly to stamps for imprinting identification or other insignia into the material of work pieces, held in rotating chucks, as for example in lathes or screw machines.

2. Description of the Prior Art

Stamps of the general class here described have long been used to imprint or inscribe identification or other insignia into the material of work pieces, whether of metal or other suitable materials. One class of such device has involved the provision of a stamp having protruding characters formed on the surface thereof and means for causing the stamp to be pressed against a rotating metal work piece to cause the stamp and work piece to move together so that the characters were imprinted into the surface of the relatively softer work piece.

Typically, prior to the present invention, such stamps have been arcuate and such constructions have been subject to certain disadvantages. In the first place the shapes of such stamps renders them relatively expensive since formation of the characters on an arcuate base requires special tooling and is thus more expensive than the cost of flat platen equivalents. Secondly, it is in the nature of such stamp structures that the entire stamp and stamp holder must be removed and replaced upon wear-out or for changes in insignia. Another disadvantage in present state-of-the-art arcuate stamps is that they often require the inclusion of positioning marks preceding the desired imprint, to engage the work piece and to start rotation of the tool at the equivalent speed of the rotating work piece surface, to prevent blurring or variable depth of the inscriptions and this puts extra and unnecessary marks on the surfaces of the stamped pieces. Still another disadvantage of the state-of-the-art technique is that the speed at which parts can be marked by such arcuate stamps is limited. Particularly as applied to high speed automatic tools such as automatic screw machines, the speed limitations placed upon over-all production rates by the stamping operation limits the cost-effectiveness of such machines.

OBJECTS AND SUMMARY OF THE INVENTION

Thus, an object of the present invention is to provide novel and improved stamping devices which are advantageously economical to manufacture and to utilize in the stamping of identification or other insignia on work pieces.

A further object of the invention is to provide novel stamping devices of the class herein described in which the stamp is of flat planar construction and has linear rather than arcuate motion relative to the outer surface of the work piece.

Still another object of the invention is to provide novel stamping devices of the class described wherein the stamp is a flat planar stamp removably retained in a flat stamp holder so that, upon wear out or a script change requirement the stamp may be easily removed and replaced.

Yet another object of the invention is to provide novel stamping devices of the class described which do not require imprint of starting marks on the work as they are used and which permit higher speed automatic operation than hitherto possible.

These and other objects and the attendant advantages thereof are realized by providing a novel stamping device adapted to be mounted on a tool slide such as the cross slide of a machine of the type in which a chuck holds work pieces and rotates them relative to tools held in tool slides and moved laterally towards and away from the work pieces. The stamping device comprises a flat planar stamp held in a stamp holder mounted on a shuttle, and includes means to latch the shuttle in a cocked position upon withdrawal of the tool slide from the axis of rotation of the work piece; means to release the shuttle upon contact of the stamp with the work piece as the tool slide moves the assembly towards the work piece; and spring means to move the shuttle and stamp to place the first character in contact with the work piece, whereby, as the work piece rotates the stamp is moved with the work piece, in contact with its outer surface, to cause the stamping operation to occur.

The aforementioned objects and advantages will become readily apparent and the invention will be better understood by reference to the following detailed description when considered in conjunction with the accmpanying drawings.

BRIEF DESCRIPTION OF THE DRAWINGS

FIG. 1 is a schematic top plan view of a metal working machine showing the invention positioned thereon.

FIG. 2 is an enlarged plan view of the arrangement schematically shown in FIG. 1, with some parts shown in phantom lines for clarity of disclosure, the stamping device being in its cocked position.

FIG. 3 is an elevational view of the FIG. 2 showing taken along the line 3—3 of FIG. 2, with hidden parts shown in phantom lines for clarity of illustration.

FIG. 4 is a perspective view, in enlarged scale, showing a typical work piece, as in FIGS. 1, 2, and 3, with insignia stamped into the surface thereof.

DESCRIPTION OF THE PREFERRED EMBODIMENT

Figure 6:
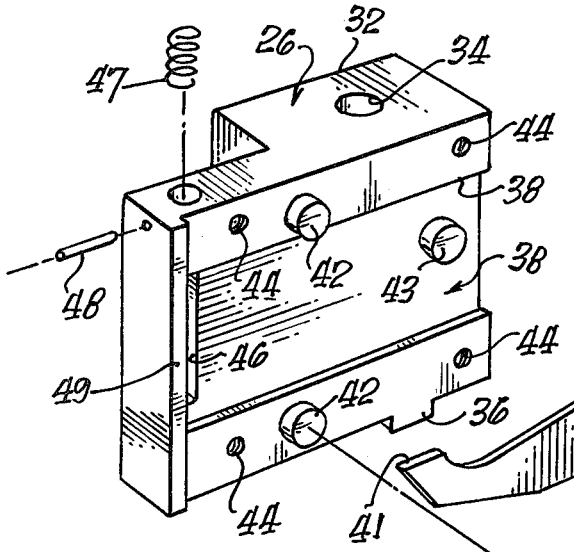
FIG. 6 is a schematic view, in reduced scale, illustrating the release of the shuttle and stamp as the tool slide on which the stamping device is mounted is advanced so that the stamp comes into contact with the work piece.
Figure 6:
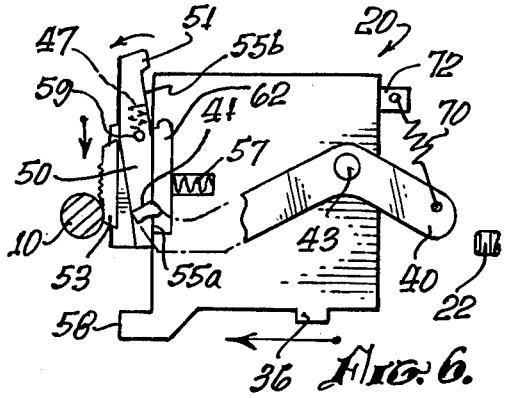

Reference is made to the drawings, wherein FIG. 1 schematically illustrates a preferred embodiment of the present invention, as mounted on the tool slide of a metalworking machine. As will be evident from the drawing, the stamping device may be utilized in any material cutting or working machine in which the work piece is mounted in a chuck for rotation past tools which are held in tool slides moving in ways formed in fixed parts of the machine bed or frame 14 for movement towards and away from the rotating work piece.

The FIG. 1 schematic view illustrates the adaptation of the present invention to a conventional material working machine of the type in which a work piece 10 is held for rotation, as by a chuck or collet 12 or the like, past tools which are held in tool slides 16, which may be advanced laterally along ways 18 on the machine bed or frame 14, towards and away from the rotating work piece, either by operator manipulation, as in simple lathes, or automatically in automatic machines such as automatic lathes or screw machines. In FIG. 1 the novel stamping device designated generally by reference numeral 20 is shown mounted on tool slide 16, in its withdrawn or cocked position, in contact with a stationary adjustable stop 22 attached to a fixed part of the machine in any suitable manner.

Reference is now made to FIGS. 2 to 8 for detailed illustration of a preferred embodiment of the invention and of the operation thereof. The stamping device comprises front and rear tool housing 24 and 26, a spacer plate 28, and a shim 30. The rear housing plate 26 includes an enlarged boss 32 in which there is provided a bore for the purpose of providing means for mounting the stamping device on a tool slide, as shown in phantom lines at 34 (FIG. 2) and positioning lugs 36 for engagement in the positioning slot 19 of the tool slide 16 (see FIG. 1).

Tool housing plate 26 is provided with a recessed area as at 38, to provide an operating chamber for the reset lever 40. The inner face of plate 26 is provided with positioning dowel pins 42, with a pin 43 which serves both as a positioning dowel pin and as a pivotal bearing for the reset lever 40, and with threaded bores as at 44 to receive threaded bolts 45 to complete the assembly as will be described.

Figure 5:
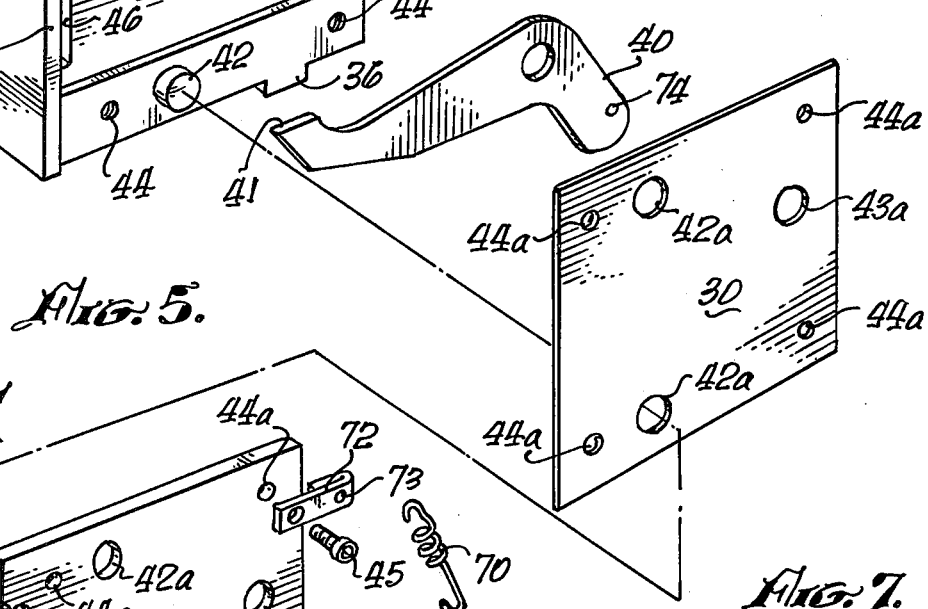
FIG. 5 is an exploded perspective view of a preferred embodiment of a stamping device according to the present invention, as illustrated in FIGS. 2 and 3.

The inner narrow portion of plate 26 is provided with a guide and spring retainer cavity as at 46, the function of which is to provide a guide for movement of guide pins 59 of a shuttle assembly (to be later described) and to house a shuttle accelerator spring 47, retained in place by a spring back-up pin 48 as best seen in FIG. 5. A flange 49 extends from the inner face of the plate 26, as shown, to enclose the reset lever and stamp shuttle.

The reset lever 40 takes the form of a flat plate having angular arms and arranged for movement around pivot 43 whereby engagement of the stop 22 with the outer extension of the lever 40 causes lifting of the other arm, which has a flat surface 41 at its end to engage and lift the stamp shuttle 50, all as will be more fully described.

The shim 30 and spacer plate 28 are each provided with dowel pin accommodation openings 42*a*, 43*a*; and with bolt holes 44*a*, all positioned to register with the bolt holes 44 on plate 26 to position the parts for assembly into the arrangement shown in FIGS. 2 and 3, the shim plate 30 being utilized to house the reset lever 40 in the recess 38 in housing 26 as best shown in FIGS. 2 and 5.

Front housing plate 24 has a slot 46*a*, therein for registration with the guide and spring retainer cavity 46 in the plate 26 when the plates are assembled and front housing plate 24, which is of lesser extent than the other plates has openings 42*a* to accommodate pins 42, and bores 44*a* to register with the bores 44 of plate 26.

Spacer plate 28 is shorter than the other plates so that when the plates are assembled a chamber is created which provides a housing for the shuttle 50. Plate 28 is provided with a lug 58 which serves to limit shuttle movement in one direction. Shuttle 50 includes an extension which has a lug 51 thereon which serves as a latch as will be later described. Spacer plate 28 is notched, as shown, to provide a housing 56 for the shuttle bearing spring 57, and to provide a stamp shuttle bearing housing 60 which includes an arcuate recess 61. the shuttle bearing housing recess 61 has an opposed flat surface 63 so that the similarly shaped flat bearing block 62 may be retained therein for pivotal motion about the center of the curved end 61*a* of the bearing block 62.

Shuttle assembly 50 is shown, in exploded perspective, in FIG. 5, and comprises a pivoting and latching device on which a stamp holder 52 is mounted. The stamp holder 52 and stamp element 53 may be made integral with the shuttle 50, requiring removal or replacement of the shuttle upon wearout or script change. However, one of the collateral advantages of the present invention is that it makes it possible to utilize removable stamp elements as shown at 53, which may be easily replaced, with less effort and machine down-time. Such stamp elements may be provided with angular, wedge-like edges, as at 54, to slip into complementary shaped recesses provided in the stamp holder 52 as clearly shown in FIG. 5, thus requiring only removal of housing plate 24 for ready access to and exchange of a stamp element.

The shuttle 50 is also provided with guide pins 59 which are adapted to be engaged in the recesses 46, 46*a* in plates 24 and 26 for guided motion of the shuttle as it is moved upwardly by reset lever 40 and downwardly by shuttle accelerator spring 47 as will be more fully described.

Various expedients could be utilized to perform latching and release functions necessary to operation of stamping devices according to the present invention. In the illustrated preferred embodiment, the inner bearing surface of the shuttle 50 is provided with angularly related flat surfaces 55*a*, 55*b*, as shown.

Front housing plate 24 completes the assembly and is provided with a retaining flange 49*a* which cooperates with retaining flange 49 on housing plate 26 to enclose the moving parts and to serve as a guide and slide for the protruding stamp element and shuttle.

With the parts in the assembled relationship shown in FIGS. 1, 2, and 3, the shuttle 50 operates in a chamber formed between housing plate 24, retaining flanges 49, 49*a*, the limit stop 58 and the wall of the spacer plate 28 containing the flat shuttle bearing 62 which is spring biased outwardly by the shuttle bearing spring 57. Shuttle 50 is biased away from latching position by engagement of the shuttle accelerator spring 47 with a guide pin 59 and is moved toward latched position by the surface 41 of the reset lever as the remote end of the reset lever is engaged by the reset stop 22, the direction of the movement of pins 59 being restrained by the guide slots 46, 46*a*.

Figure 7:
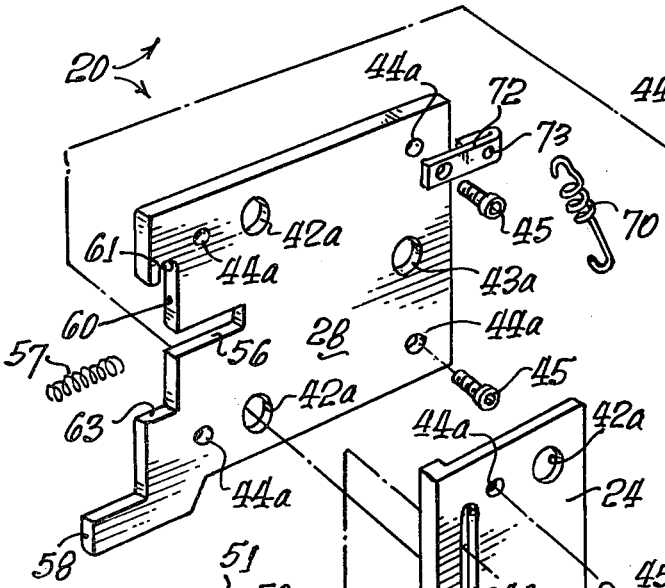
FIG. 7 is a view similar to FIG. 6, illustrating how rotation of the work piece pulls the stamp surface across the surface of the work piece.
Figure 7:
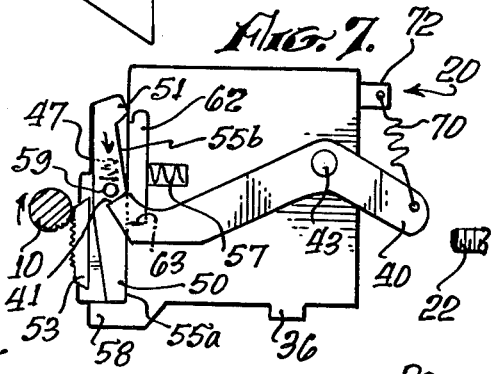
Figure 8:
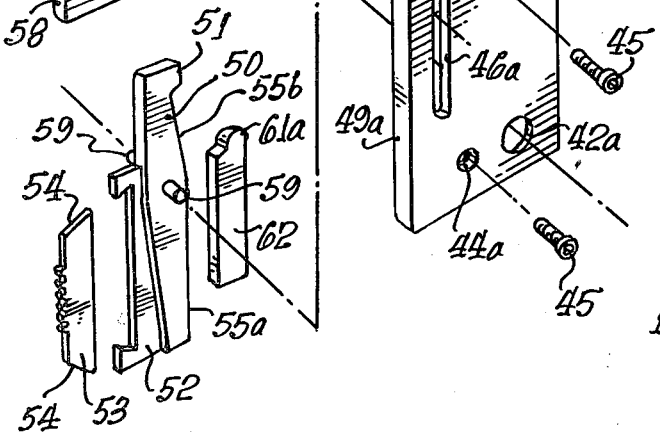
FIG. 8 is a view similar to FIGS. 6 and 7 illustrating how withdrawal of the tool slide on which the stamping device is mounted causes latching of the stamp shuttle in cocked position.
Figure 8:
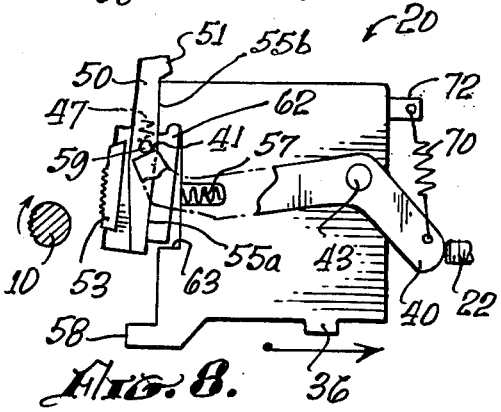

Attention is directed to the schematic showings in FIGS. 6, 7, and 8, for description of a cycle of operation of the device. In the latched position of FIG. 8, engagement of the end of reset lever 40 with the stop 22 has caused the lever arm bearing the surface 41 to move in a direction to engage a pin 59 to move the shuttle 50 to the position shown in FIG. 8. As this movement was completed the shuttle bearing spring, pushing against the bearing block 62 and the shuttle 50 caused shuttle 50 to pivot about the line of intersection of surfaces 55*a* and 55*b* to cause the latch 51 to engage, in the latched position, upon the edge of the spacer plate 28, as shown.

If desired, means may be provided to move reset lever 40 out of the path of the guide pins 59 of the shuttle 50 once the shuttle is in the latched position in order to relieve the shuttle accelerator spring 47 of the burden of overcoming the weight of the reset lever and frictional forces attendant to its movement. for this purpose a return spring 70 may be utilized and may be anchored at one end to the stamp device to bias the reset lever toward a position out of contact with pins 59. Spring 70 may be attached to the stamp assembly by any suitable means, as by provision of a support strip 72 mounted on the assembly by insertion under one of the bolts 45, as shown. Strip 72 has an opening 73 into which one end of coil spring 70 is hooked, the other end being hooked into an opening 74 in the outwardly extended arm of the reset lever 40.

As the tool slide begins movement towards the work piece, the exposed end of the reset lever moves out of engagement with the stop 22 and spring 70 moves the reset lever out of engagement with guide pins 59 and out of the path of movement of said pins. Continued movement of the tool slide continues until the stamp surface contacts the rotating work. When the stamp 53 contacts the work piece, pressure is exerted against the shuttle, which overcomes the pressure of the shuttle bearing spring and pushes bearing block 62 back into its housing. This causes pivoting of the shuttle to the FIG. 6 position to release the latch 51 and permit the shuttle to move across the surface of the rotating work piece as shown in FIG. 7, urged in the direction of this movement by shuttle accelerator spring 47. The shuttle accelerator spring is ideally a coil spring of a size and strength such that the shuttle, upon release, may be quickly accelerated to a speed as close as possible to the speed of the surface of the rotating work piece, thus contributing to the improved speeds at which devices according to the present invention may be operated.

When the first character on the stamp is engaged by the work piece, the result is a surface engagement of the stamp with the surface of the work piece to cause the stamp surface and work piece surface to move together and to imprint the characters on the stmp face into the material of the work piece. Movement of the stamp and stamp shuttle is limited by engagement of the shuttle with the stop 58. Withdrawal of the tool slide from the work piece brings the end of the reset lever 40 into contact with the stop 22 to cause movement of the shuttle and cocking thereof in the latched position, as previously described, in readiness for the next cycle of operation.

In use, the movement of the tool slide is adjusted so that its innermost position relative to the work piece is at the precise point at which the latch 51 of the shuttle 50 is released. The depth of the imprint in the work piece is therefore controlled by the height of the upstanding characters on the stamp element 53 since the tool slide is retained in this innermost position until the stamp element has been pulled entirely across the work piece.

Experience has shown that flat stamps having cocking and release means of the general type herein disclosed and which have linear motion relative to the work piece may be operated at substantially higher speeds than the known prior art arcuate stamps in similar applications. Such higher speeds permit higher production rates and improved economy, particularly in automatic machine applications, such as in screw machines.

From the foregoing it may be seen that the objects of this invention are achieved by novel structures which provide a flat stamping element, means to mount said element on a tool slide, and simple means to withdraw such element from contact with the work piece and to latch the stamping element in said withdrawn position as the tool slide is moved outwardly from the work and to release said latch and move the stamping element into such a position that the upstanding characters thereon are brought into engagement with the work piece when the tool slide moves inwardly to a position in which the stamping element engages the work piece.

It should be understood that the specific preferred embodiment described and illustrated herein is by way of example only and that many variations in dimension; in specific straight surface stamping element mounting means; and in specific latching and unlatching mechanisms could be utilized without departing from the spirit of the invention. Rather it is intended that the spirit and scope of the invention be as defined in the following claims.

What is claimed is:

1. A stamping device adapted to be mounted on the tool slide of a machine such as a lathe or screw machine for imprinting characters or other insignia into the surface of a work piece held in the rotating chuck of said machine; said stamping device comprising a stamp element having raised characters on the outer surface thereof, means responsive to movement of the tool slide to its outermost position to move the stamp element to a relatively withdrawn position and to latch it in said withdrawn position, means to bias said stamp element from said withdrawn position, and means responsive to engagement of the stamp element with the peripheral surface of the rotating work piece upon inward movement of the tool slide to an innermost position to release said stamp element from said latched withdrawn position to permit said biasing means to move the surface of the stamp element tangentially with the rotating work piece to cause imprint of said raised characters or other insignia into the material of said work piece.

2. A stamping device according to claim 1 wherein said first mentioned means comprises a shuttle element on which said stamp element is mounted, a reset lever adapted to move said shuttle element to said withdrawn position when engaged by a stop on a fixed portion of the machine as the tool slide reaches said outermost position.

3. A stamping device according to claim 2 having means to latch said shuttle in said withdrawn position.

4. A stamping device according to claim 3 wherein said second named means include means to release said latch means as the stamp element surface engages the work piece and spring means adapted to accelerate the shuttle at a speed and in a direction so that the speed of movement of the stamp element surface quickly approximates the speed of movement of the work piece surface.

5. A stamping device adapted to be mounted on the tool slide of a machine such as a lathe or screw machine for imprinting characters or other insignia into the surface of a work piece held in the rotating chuck of said machine; said stamping device comprising a stamp element having a flat planar surface and having raised characters or insignia thereon, means responsive to movement of the tool slide to its outermost position to move the stamp element to a relatively withdrawn position in which the flat surface but not the raised characters or insignia of the stamp element is aligned with and facing the work piece, means responsive to inward movement of the tool slide to an innermost position in which the said flat surface of the stamp element engages the surface of the rotating work piece to move the stamp element surface linearly and in contact with the outer surface of the rotating work piece until a raised character or insignia on the stamp element is engaged by and enters into the material of the work piece, whereby the rotation of the work piece causes the work piece surface and the flat stamp element to move together to cause imprintment of the raised characters or insignia into the material of the work piece.

6. A stamping device according to claim 5 wherein said stamp element is mounted on a shuttle for movement from said withdrawn position to said position in which a raised character or insignia is engaged by the work piece.

7. A stamping device according to claim 6 wherein said means responsive to movement of the tool slide to its outermost position to move the stamp element to a withdrawn position comprises a reset lever mounted for pivoted movement and responsive to contact with a fixed portion of the machine to contact and move said shuttle to said withdrawn position.

8. A stamping device according to claim 7 having means to latch said shuttle in said withdrawn position as the tool slide reaches said outermost position, and means to release said latch means as the cross slide reaches its innermost position, with the samp element surface in contact with the surface of the work piece.

9. A stamping device according to claim 8 having spring means normally biasing said shuttle from said withdrawn position in a direction to move the stamp element surface across the surface of the work piece upon release of said latch means.

10. A stamping device according to claim 9 wherein said spring means is of a size and strength such as to accelerate shuttle at a rate such that the speed of movement of the stamp element surface quickly approximates the speed of movement of the work piece surface.

11. A stamping device according to claim 9 further including means to move said reset lever out of contact with said shuttle and out of the path of movement of said shuttle when said tool slide starts to move from its said outermost position towards said innermost position.

12. A stamping device according to claim 6 wherein the stamp element is mounted on the shuttle by being removably attached to a stamp holder which is fixed to said shuttle.

13. A stamping device according to claim 12 wherein the stamp holder is provided with a notch at its exposed edge, the said notch having inwardly diverging end walls, the stamp element body being of shape to closely fit within said notch whereby the stamp element may be readily installed and removed in the stamp holder.

14. A stamping device adapted to be mounted on the cross slide of a machine such as a lathe or screw machine for imprinting characters or other insignia into the surface of a work piece held in the rotating chuck of said machine; said stamping device comprising an outer casing, means for mounting the stamping device on a tool slide, a stamp element having a flat planar surface and having raised characters or insignia thereon, a shuttle operative within said casing, said stamp element being mounted on said shuttle in a manner to project externally of said casing for contact with a work piece, means responsive to movement of the tool slide to its outermost position to move the shuttle and the stamp element to a position withdrawn relative to the work piece so that the flat surface but not the raised characters or insignia of the stamp element are aligned with and face the work piece, means responsive to inward movement of the tool slide to an innermost position in which the said flat surface of the stamp element engages the surface of the rotating work piece to move the stamp element surface linearly and in contact with the outer surface of the rotating work piece until a raised character or insignia on the stamp element is engaged by and enters into the material of the work piece, whereby entry of the raised characters or insignia into the material of the rotating work piece causes the work piece surface and the flat stamp element to move together to cause imprintment of the raised characters or insignia into the material of the work piece.

15. A stamping device according to claim 14 having means to latch said shuttle in said withdrawn position as the tool slide reaches its outermost position, said latch means comprising a lug on one end of said shuttle, said lug being adapted to engage and latch on a portion of said casing as the tool slide reaches said outermost position and means to release said latch as the tool slide reaches its innermost position, with the stamp element surface in contact with the work surface.

16. A stamping device according to claim 14 wherein said means responsive to movement of the tool slide to its outermost position to move the stamp element to a withdrawn position comprises a reset lever mounted for pivoted movement and responsive to contact with a fixed portion of the machine to move said shuttle to said withdrawn position.

* * * * *